US006310584B1

(12) United States Patent
Reece et al.

(10) Patent No.: US 6,310,584 B1
(45) Date of Patent: Oct. 30, 2001

(54) LOW PROFILE HIGH POLARIZATION PURITY DUAL-POLARIZED ANTENNAS

(75) Inventors: John K. Reece; John L. Aden, both of Colorado Springs, CO (US)

(73) Assignee: Xircom Wireless, Inc., Colorado Springs, CO (US)

( * ) Notice: Subject to any disclaimer, the term of this patent is extended or adjusted under 35 U.S.C. 154(b) by 0 days.

(21) Appl. No.: 09/484,058

(22) Filed: Jan. 18, 2000

(51) Int. Cl.[7] ..... H01Q 21/00
(52) U.S. Cl. ..... 343/816; 343/795; 343/725
(58) Field of Search ..... 343/816, 812, 343/813, 814, 727, 829, 725, 795, 807

(56) References Cited

U.S. PATENT DOCUMENTS 5,771,024 * 6/1998 Reece et al. ..... 343/725
5,771,025 * 6/1998 Reece et al. ..... 343/828
6,121,935 * 9/2000 Reece et al. ..... 343/725

* cited by examiner

*Primary Examiner*—Don Wong
*Assistant Examiner*—Ephrem Alemu
(74) *Attorney, Agent, or Firm*—Lyon & Lyon LLP

(57) ABSTRACT

An antenna system for use in cellular and other wireless communication includes a dual polarized compact antenna array. In one embodiment, the antenna system includes four T-shaped dipole antenna elements mounted on a ground plane, forming a side of a square shaped array. In another embodiment, the antenna system includes seven T-shaped dipole antenna elements mounted on a ground plane to form two side by side square arrays, wherein the square arrays share a common T-shaped dipole antenna element.

10 Claims, 10 Drawing Sheets

LOW PROFILE HIGH POLARIZATION PURITY DUAL-POLARIZED ANTENNAS

INTRODUCTION

This application pertains to the field of antennas and antenna systems and more articularly pertains to antennas for use in wireless communication systems.

BACKGROUND OF THE INVENTION

Urban and suburban RF environments typically possess multiple reflection, scattering, and diffraction surfaces that can change the polarity of a transmitted signal and also create multiple images of the same signal displaced in time (multipath) at the receiver location. Within these environments, the horizontal and vertical components of the signal will often propagate along different paths, arriving at the receiver decorrelated in time and phase due to the varying coefficients of reflection, transmission, scattering, and diffraction present in the paths actually taken by the signal components. Note that the likely polarization angle of an antenna on a handset used in cellular communication systems to the local earth nadir is approximately 60° towards horizontal (this may be readily verified by drawing a straight line between the mouth and ear of a typical human head and measuring the angle that the line makes with respect to the vertical). The resulting offset handset antenna propagates nearly equal amplitude horizontal and vertical signals subject to these varying effects of an urban/suburban RF environment. As a mobile phone user moves about in such an environment, the signal amplitude arriving at the antenna on the base station antenna the handset is communicating with will be a summation of random multiple signals in both the vertical and horizontal polarizations.

The summation of the random multiple signals results in a signal having a Rayleigh fading characterized by a rapidly changing amplitude. Because the signal arriving at the base station often has nearly identical average amplitude in the vertical and horizontal polarizations that are decorrelated in time and/or phase, the base station receiver may choose the polarization with the best signal level at a given time (selection diversity) and/or use diversity combining techniques to achieve a significant increase in the signal to noise ratio of the received signal.

Prior art base station antennas that may be used in a selection diversity or diversity combining system often use two separate linearly polarized antennas. This makes for a bulky and unwieldy arrangement because of the space required for each antenna and its associated hardware. U.S. Pat. No. 5,771,024, the contents of which are incorporated by reference, discloses a compact dual polarized split beam or bi-directional array. There is a need in the art, however, for a compact dual polarized boresight array.

SUMMARY OF THE INVENTION

The present invention is directed to a dual polarized antenna array for use in wireless communication systems. The antenna array of the present invention may be deployed in relatively small, aesthetically appealing packages and, because the arrays are dual polarized, the arrays may be utilized to provide substantial mitigation of multipath effects.

In one innovative aspect, the present invention is directed to an antenna array comprising a first and a second T-shaped dipole antenna mounted on a ground plane wherein the first and second T-shaped dipoles are aligned along mutually parallel axes such that the first and second dipoles transmit and receive a first polarization. A third and a fourth T-shaped dipole antennas are mounted on the ground plane wherein the third and fourth T-shaped dipoles are aligned along mutually parallel axes such that the third and fourth dipoles are aligned to transmit and receive a second polarization, the second polarization being orthogonal to the first polarization. A first equal phase power divider is coupled to the first and second T-shaped dipoles and a second equal phase power divider is coupled to the third and fourth T-shaped dipoles. The first and second T-shaped dipoles are preferably spaced apart broadside to one another approximately a half wavelength of an operating frequency. Similarly, the third and fourth T-shaped dipoles are preferably spaced apart broadside to one another approximately a half wavelength of the operating frequency. Such an array produces a boresight beam with equal elevation and azimuth (E and H plane) beatnwidths in both the vertical and horizontal polarizations.

In another innovative aspect of the invention, additional antenna elements are added to produce unequal elevation and azimuth beamwidths. For example, a first and a second T-shaped dipole are mounted along a first axis of a ground plane. A third and a fourth T-shaped dipole are mounted along a second axis of the ground plane wherein the first and second axes are mutually parallel. A fiftih, sixth, and a seventh T-shaped dipole are mounted on a third, fourth, and fifth axis of the ground plane, respectively, wherein the third, fourth, and fifth axes are orthogonal to the first and second axes. The fifth, sixth, and seventh T-shaped dipoles are positioned between the first and second axes and the sixth antenna element is positioned between the first and second T-shaped dipoles.

In a preferred embodiment, the first and second T-shaped dipoles are spaced apart a half wavelength of an operating frequency along the first axis. Similarly, the third and fourth T-shaped dipoles are spaced apart a half wavelength of the operating frequency along the second axis that, in turn, is spaced apart a half wavelength from the first axis. Finally, the third, fourth, and fifth axes are spaced apart from one another a half wavelength of the operating frequency. If the first and second axes are positioned to extend in the direction defining vertical polarization, the elevation (E plane) beamwidth of the array is 30° whereas the azimuth beamwidth is 65° for both the vertically and the horizontally polarized signals. Additional antenna elements can be added along the first and second axes to further narrow the elevation beamwidth.

DETAILED DESCRIPTION

Figure 1A:
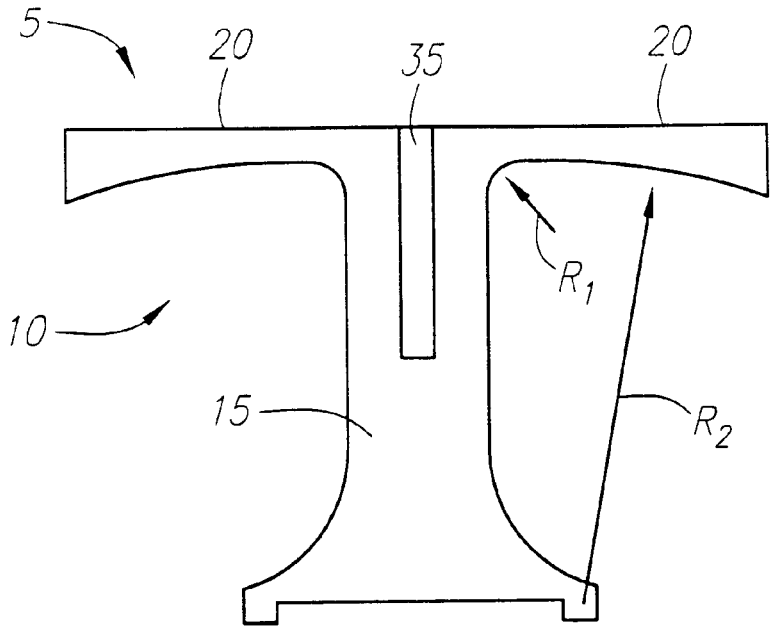
FIG. 1*a* is an illustration of the main radiating element of a T-shaped dipole antenna element according to the present invention.
Figure 1B:
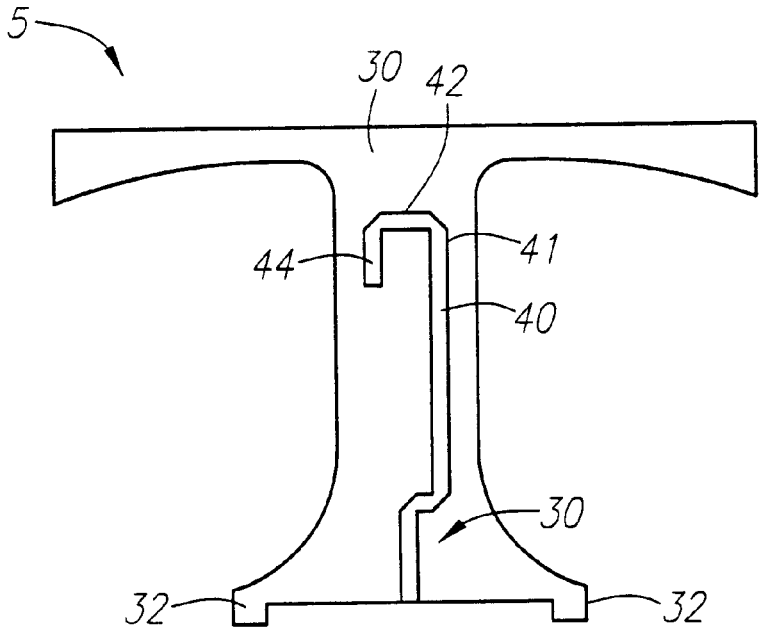
FIG. 1*b* is an illustration of a reactive feed element of the T-shaped dipole antenna shown in FIG. 1*a*.
Figure 2A:
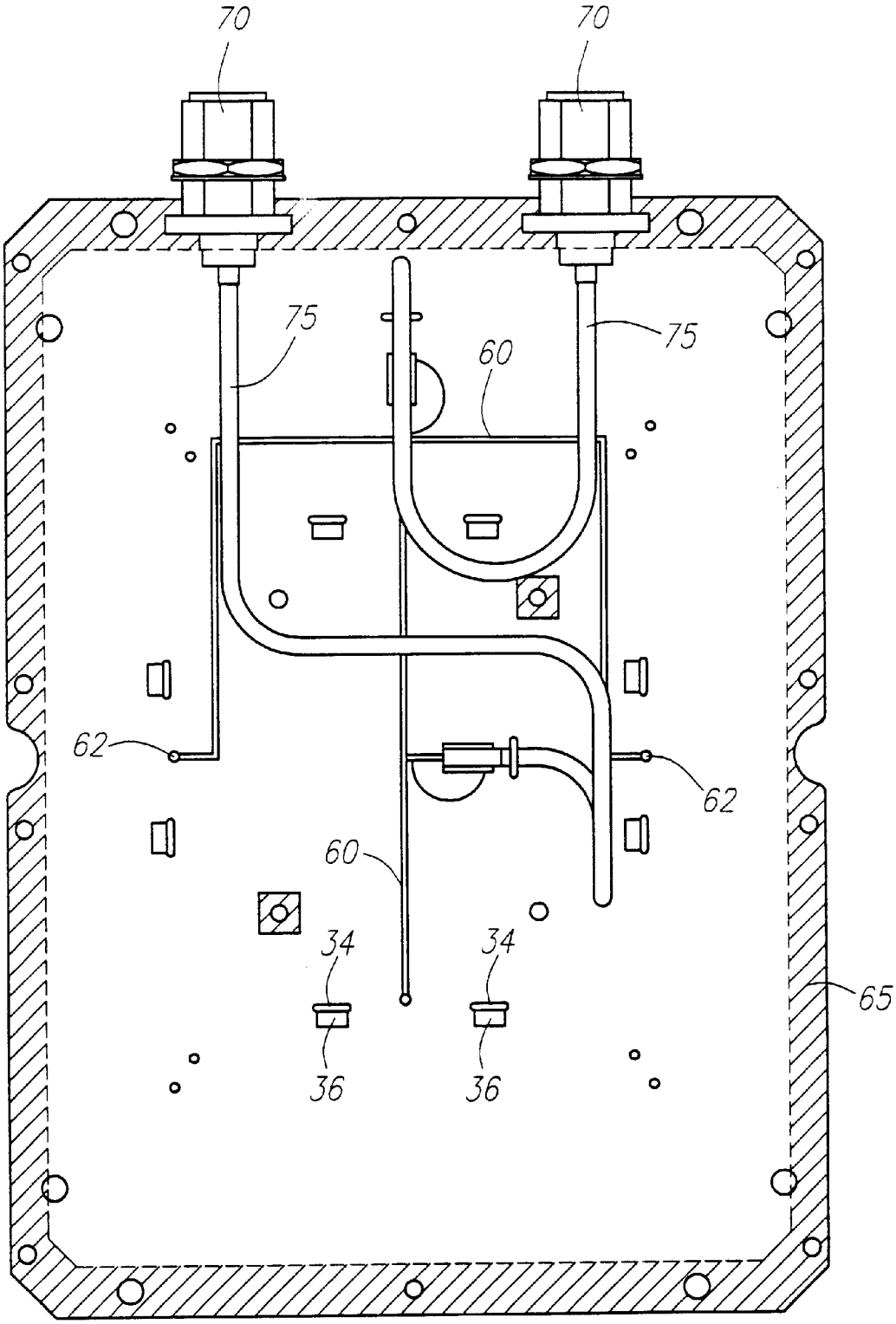
FIG. 2*a* is a plan view of the bottom surface of the ground plane of an array having four T-shaped dipole antenna elements according to one embodiment of the invention.
Figure 2B:
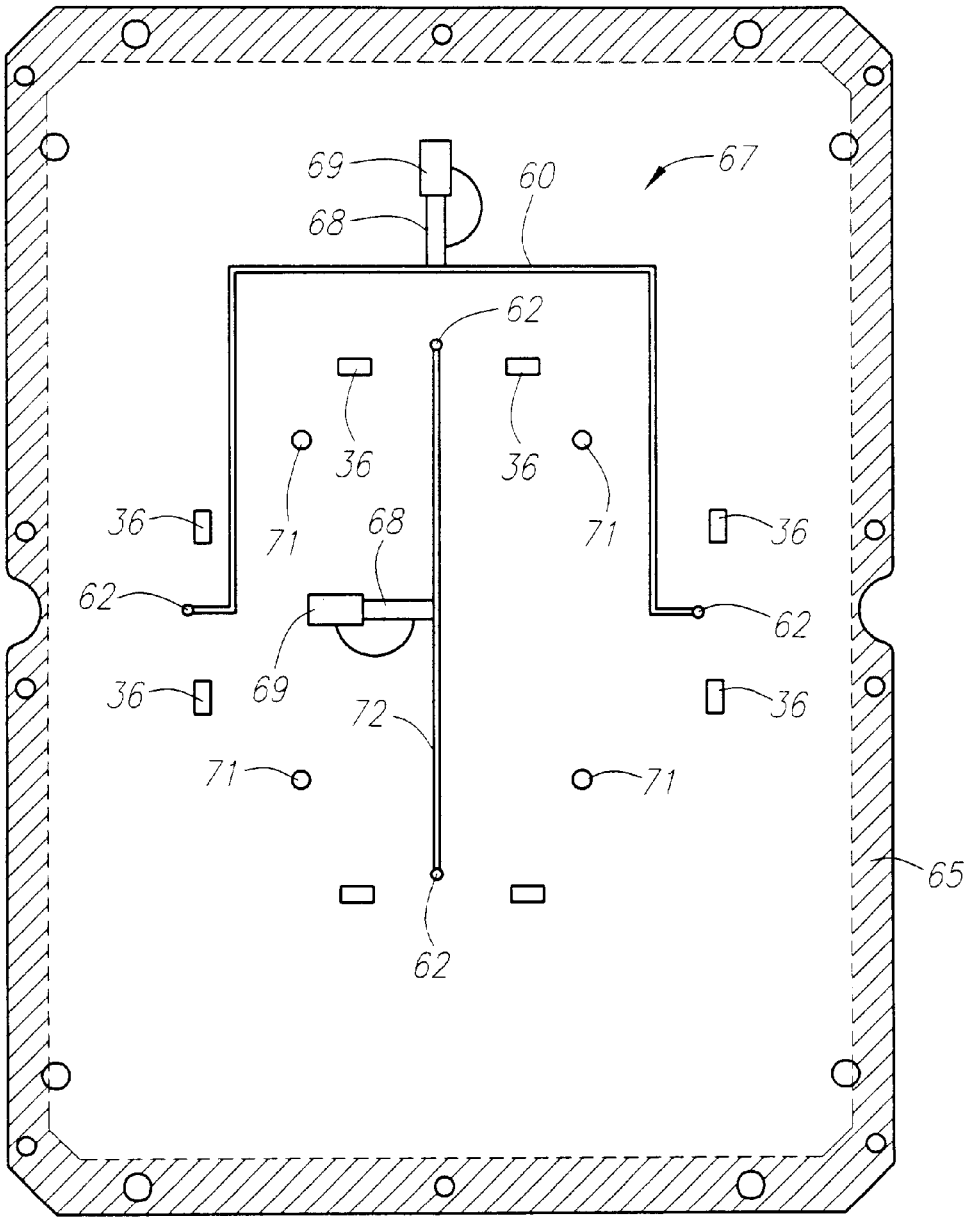
FIG. 2*b* illustrates the ground pads and microstrips for bottom surface of the ground plane of the antenna array of FIG. 2*a*.

Turning to the figures, in one innovative aspect the present invention is directed to the implementation of a square T-shaped dipole antenna. As shown in FIGS. 1*a*–1*b*, a T-shaped dipole antenna element 5 comprises a large T-shaped radiating element 10 having a longitudinally extending stem 15 and a pair of laterally extending arms 20. The T-shaped radiating element 10 and a reactive feed strip 40 are formed on opposite sides of a PC board substrate 30. The reactive feed strip 40 is arranged to produce an antipodal excitation across a longitudinally extending slot 35 in the stem 15. The reactive feed strip has a first portion 41 extending from the base of the stem to an end along a first side of the slot 35. A second portion 42 of the reactive feed strip crosses the slot 35 to connect the end of the first portion 41 to a third portion 44 of the reactive feed strip. The third portion 44 extends downwardly on a second side of the slot 35. In this fashion, the reactive feed strip 40 includes an antipodal excitation across the slot 35, thereby making a dipole antenna. It will be appreciated that the radiating element 10 and the reactive feed strip 40 may be and are preferably manufactured by depositing copper cladding in a conventional manner over opposite surfaces of the printed circuit board substrate 30, followed by etching portions of the copper cladding away to form the radiating element 10 and the feed strip 40. The printed circuit board may be manufactured from woven TEFLON® having a thickness of approximately 0.03 inches and an epsilon value (or delectric constant) between 3.0 and 3.3.

The upper edge of the arms 20 are aligned with the top of the stem 15. The lower edge of each arm 20 comprises a first arcuate segment having a radius R1 and a second arcuate segment having a radius R2 wherein the first arcuate segment merges with the edge of the stem 15. In a preferred embodiment of the T-shaped antenna 5, the T-shaped radiating element 10 is 2.8 inches across the top and 1.97 inches high. The width of the stem is 0.6 inches. The radius R1 is 0.2 inches, and the radius R2 is 1.82 inches. The slot 35 is 0.15 inches wide and 0.95 inches long. The reactive feed strip 40 is 0.07 inches wide. The second portion 42 of the feed strip is located 0.4 inches from the top of the T-shaped radiating element 10. The third portion 44 has a length of 0.3 inches. While these dimensions are optimal for transmission at a center frequency of 1850 MHZ, those of ordinary skill in the art will appreciate that the dimensions of the various elements will vary depending upon the operational characteristics desired for a particular application.

Turning now to FIGS. 2*a* through 5, in another innovative aspect the present invention is directed to a dual polarized array of four T-shaped dipole antenna elements 5 arranged in a square configuration on a ground plane 50. The T-shaped dipole antenna elements are preferably formed as described with respect to FIGS. 1*a* and 1*b*. The ground plane 50 may comprise a printed circuit board substrate having opposing coplanar surfaces (i.e., a top surface illustrated in FIG. 3 and a bottom surface illustrated in FIG. 5) whereon respective layers of copper cladding are deposited. Features on the ground plane, such as microstrip feed lines 60 located on the bottom surface are preferably formed by etching away portions of the deposited copper cladding. The dipole antenna elements 5 mount to the ground plane 50 by inserting tabs 32 into slots 34. The tabs are soldered to the top surface of the ground plane 50 and to grounding pads 36 located on the bottom surface of the grounding plane 50.

The reactive feed strip 40 of the dipole antenna is preferably connected to microstrips 60 by feed pins (not illustrated) that extend through insulated holes 62. The microstrips 60 are arranged so as to form two equal phase power dividers 67 wherein each power divider 67 is excited at a center pad 68. A power source (not illustrated) couples to the dipole antennas through coaxial connectors 70. The coaxial connectors 70 may be standard type N coax connectors sized to receive 0.082 inch diameter coaxial cable. The inner conductor of the coaxial connector couples to center pads 68 (and ultimately, the equal phase power dividers 67) adjacent to center ground pads 69 through wires 75. As can be seen from inspection of FIG. 2*a*, the sections of microstrip 60 that couple from the center pads 68 to the insulated holes 62 are of equal length in each equal phase power divider 67. In this fashion, the reactive feed strips 30 of each dipole antenna element 5 attached to a given equal phase power divider are fed in phase with one another because the electrical energy will have traveled the same electrical length at each reactive feed strip.

Figure 3:
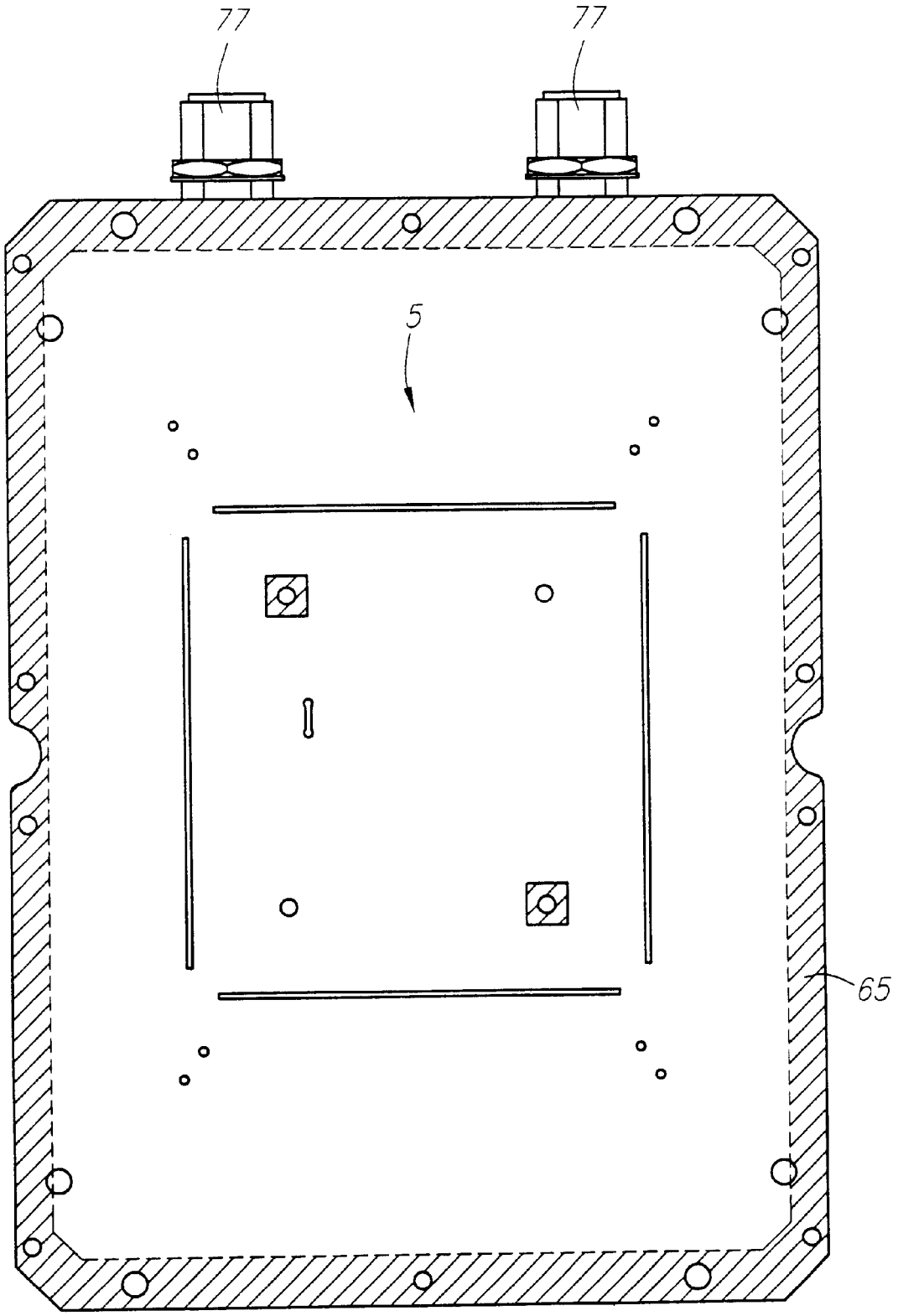
FIG. 3 is a plan view of the top surface of the ground plane of the array of FIG. 2*a*.
Figure 4:
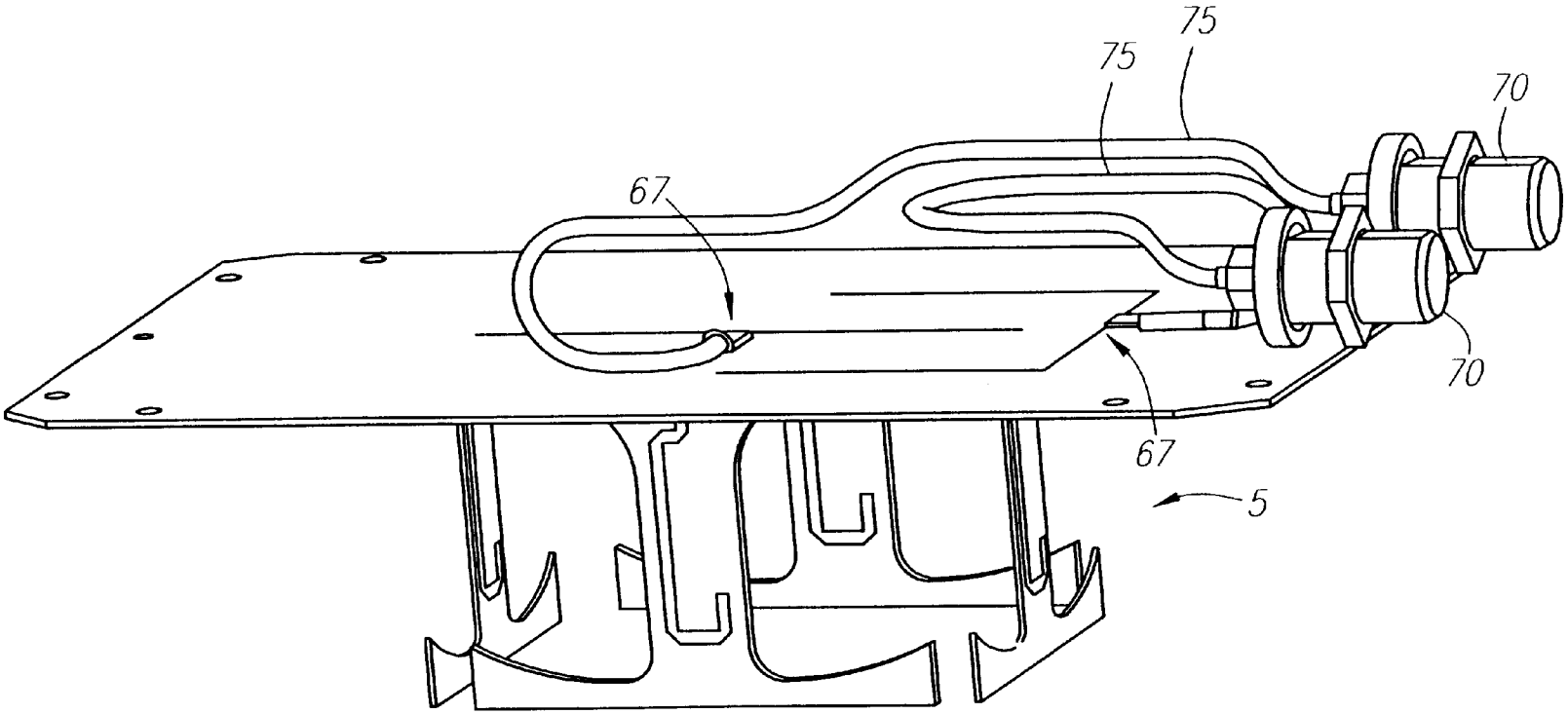
FIG. 4 is a perspective view of the bottom surface of the ground plane of the array of FIG. 2*a*.

As can be seen from FIGS. 3 and 4, four dipole antenna elements 5 are arranged in pairs wherein each pair of antenna elements is coupled to an equal phase power divider 67. A first pair of antenna elements are aligned on mutually parallel axes 77. Because the arms 20 of the first pair of dipole antenna elements 5 are aligned on the axes 77, the electric field produced by this first pair will be polarized parallel to axes 77. A second pair of dipole antenna elements are aligned on mutually parallel axes 78 wherein the axes 78 are orthogonal to the axes 77. In this fashion, the electric field produced by the second pair of antenna elements will be orthogonally polarized to the field produced by the first pair of antenna elements. Thus, the resulting antenna array forms a square wherein the pairs of dipole antenna elements form opposing sides of the square.

The outer conductors of the coaxial connectors 70 are coupled to the copper cladding coating the upper surface of the ground plane 50. In addition, an array of small perforations (not shown) are distributed around the periphery 65 and on the center ground pads 69 as well as holes 71 act as ground vias. This insures that the respective copper cladding layers form a single, unified ground plane. To provide an impedance match between the microstrips 60 and the reactive feed strips 30, a quarter wave length transition section of microstrip line 72 is implemented. The dimensions that follow correspond to a center frequency of 1850 MHZ. Those of ordinary skill in the art will appreciate that the dimensions would be altered accordingly for a differing center frequency. In one embodiment, the microstrip line is 0.020 inches wide whereas the quarter wave length transition section is 0.031 inches wide and 0.97 inches long.

In order to provide a half-wavelength spacing between identically polarized dipole elements 5, the pair of mutually parallel axes 77 are spaced apart a half wavelength. Similarly, the pair of mutually parallel axes 78 are also spaced apart a half wavelength. At the preferred operating frequency of 1710 to 1990 MHZ, the axes are spaced apart a distance of substantially 3.3 inches.

Figure 5:
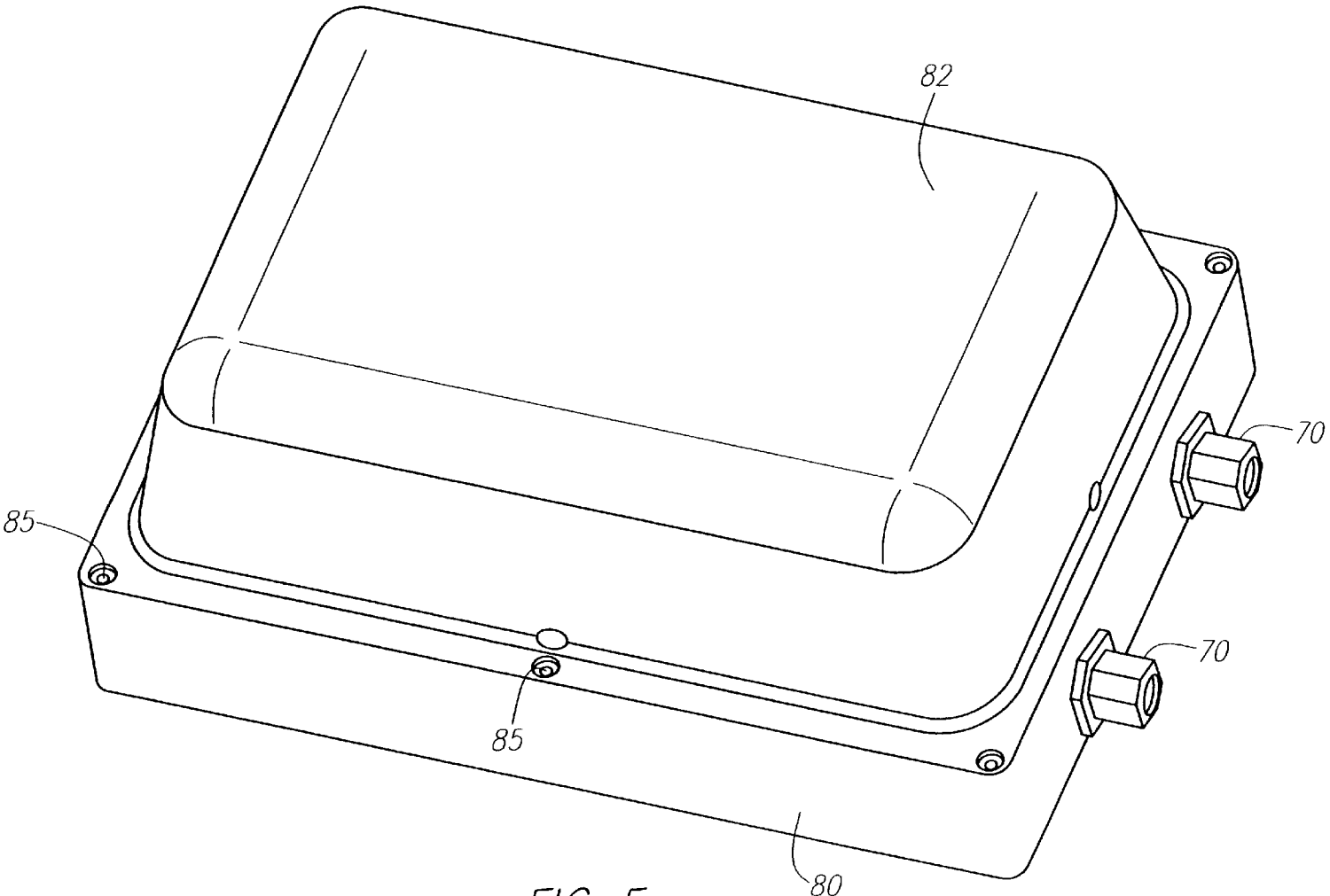
FIG. 5 is a perspective view of the enclosure for the array of FIG. 2*a*.
Figure 6A:
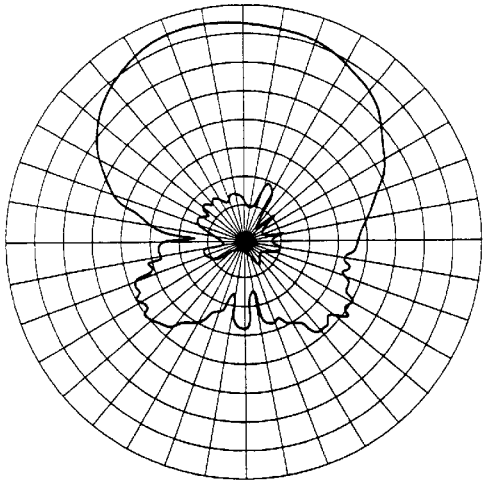
FIG. 6*a* is an illustration of the horizontally polarized E-plane cut radiation pattern of the array of FIG. 2*a*.
Figure 6B:
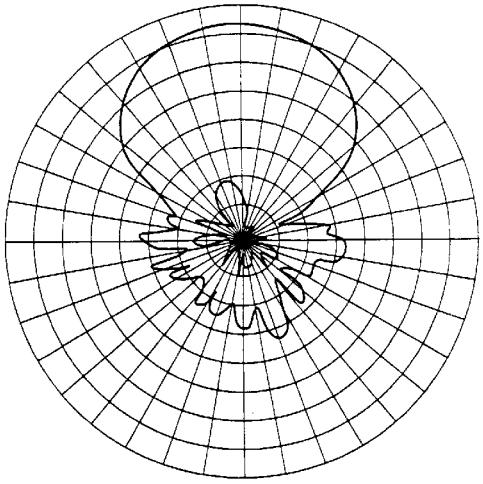
FIG. 6*b* is an illustration of the horizontally polarized H-plane cut radiation pattern of the array of FIG. 2*a*.
Figure 6C:
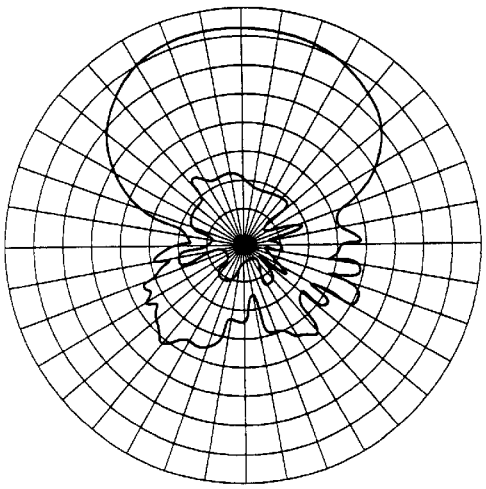
FIG. 6*c* is an illustration of the vertically polarized E-plane cut radiation pattern of the array of FIG. 2*a*.
Figure 6D:
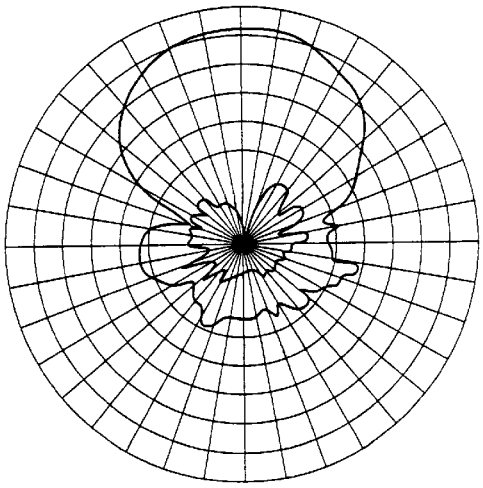
FIG. 6*d* is an illustration of the vertically polarized H-plane cut radiation pattern of the array of FIG. 2*a*.

Turning now to FIG. 5, in a preferred form the dual polarized four T-shaped antenna element array may be mounted in a casing comprising an aluminum base 80 and a plastic cover 82. The aluminum base 80 is formed such that the ground plane 50 containing the antenna elements 5 may be mounted within a step (not illustrated) formed in the outer wall of the base 80, and such that the ground plane 50 is coupled to the base 80 by means of a set of screws (not illustrated) through the periphery 65 of the ground plane 50 insuring that the base 80 remains grounded during operation of the antenna array. The base 80 also has formed therein a pair of mounts for the coaxial connectors 70 and a series of threaded holes for receiving a plurality of screws 85 that secure the cover 82 to the base 80. Those of ordinary skill in the art will appreciate that, to avoid possible intermodulation effects, the cover 82 may be glued to the base 80 using an adhesive such as RTV, rather than using screws 85 to secure the cover 82 to the base 80.

The dual polarized four T-shaped antenna element array embodiment of the present invention produces a single boresight beam which projects orthogonally from the ground plane 50 through the cover 82. In the field, the antenna element would be mounted on the wall of a building or on a light pole or other structure. One pair of the antenna elements, for example that illustrated on axes 77, could be aligned with the vertical direction such that the antenna elements aligned with axes 77 will transmit and receive vertically polarized fields. Conversely, the antenna elements aligned on axes 78 would then transmit and receive horizontally polarized fields. FIGS. 6*a* through 6*d* illustrate the elevation beamwidth (E-Plane) and azimuth beamwidths (H-Plane) for the horizontally polarized and vertically polarized components, respectively. Inspection of the figures reveals that the azimuth and elevation beamwidths for the vertical and horizontal polarized components are equal to approximately 65°.

Figure 7:
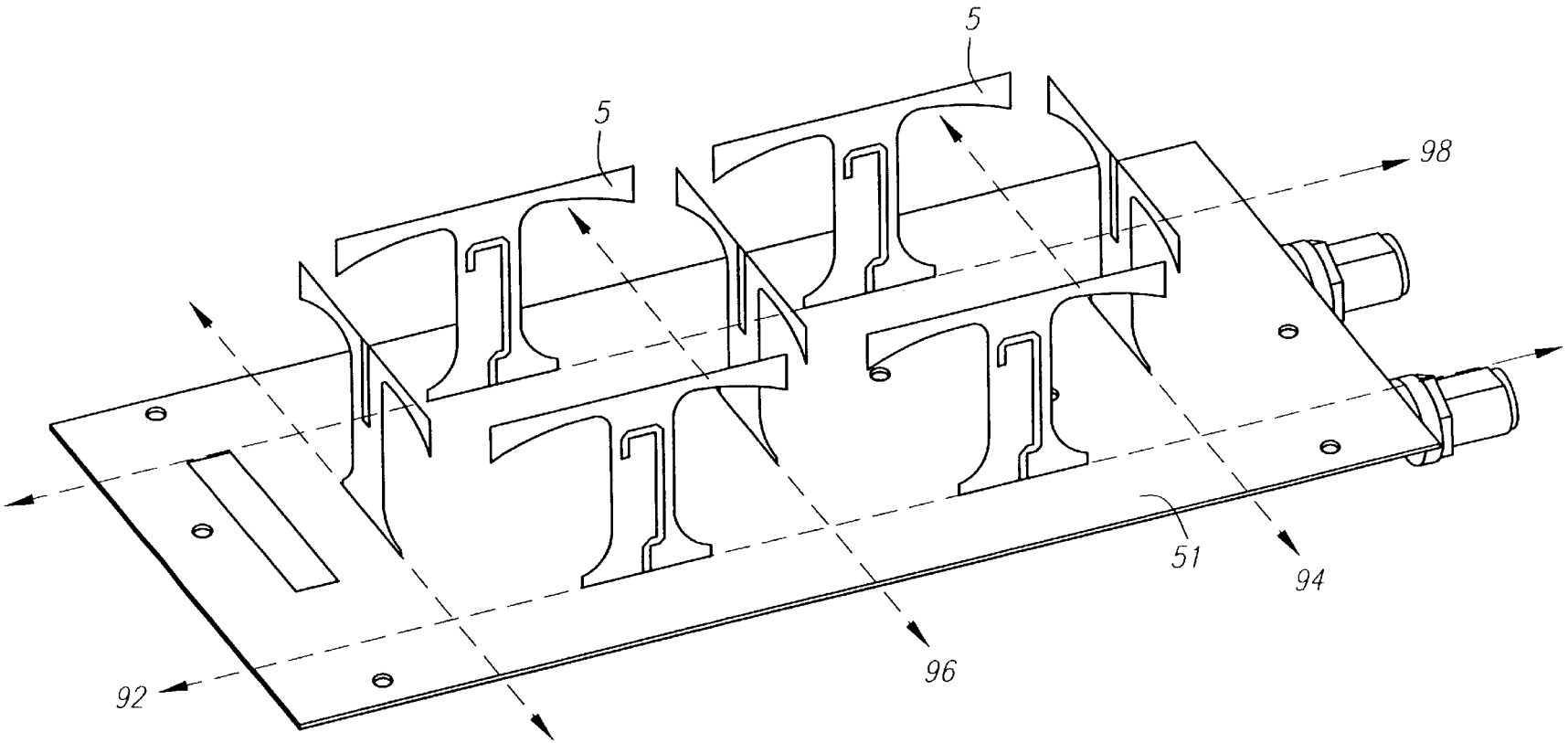
FIG. 7 is a perspective view of the top surface of a ground plane having seven T-shaped dipole antenna elements mounted thereon according to one embodiment of the invention.
Figure 8:
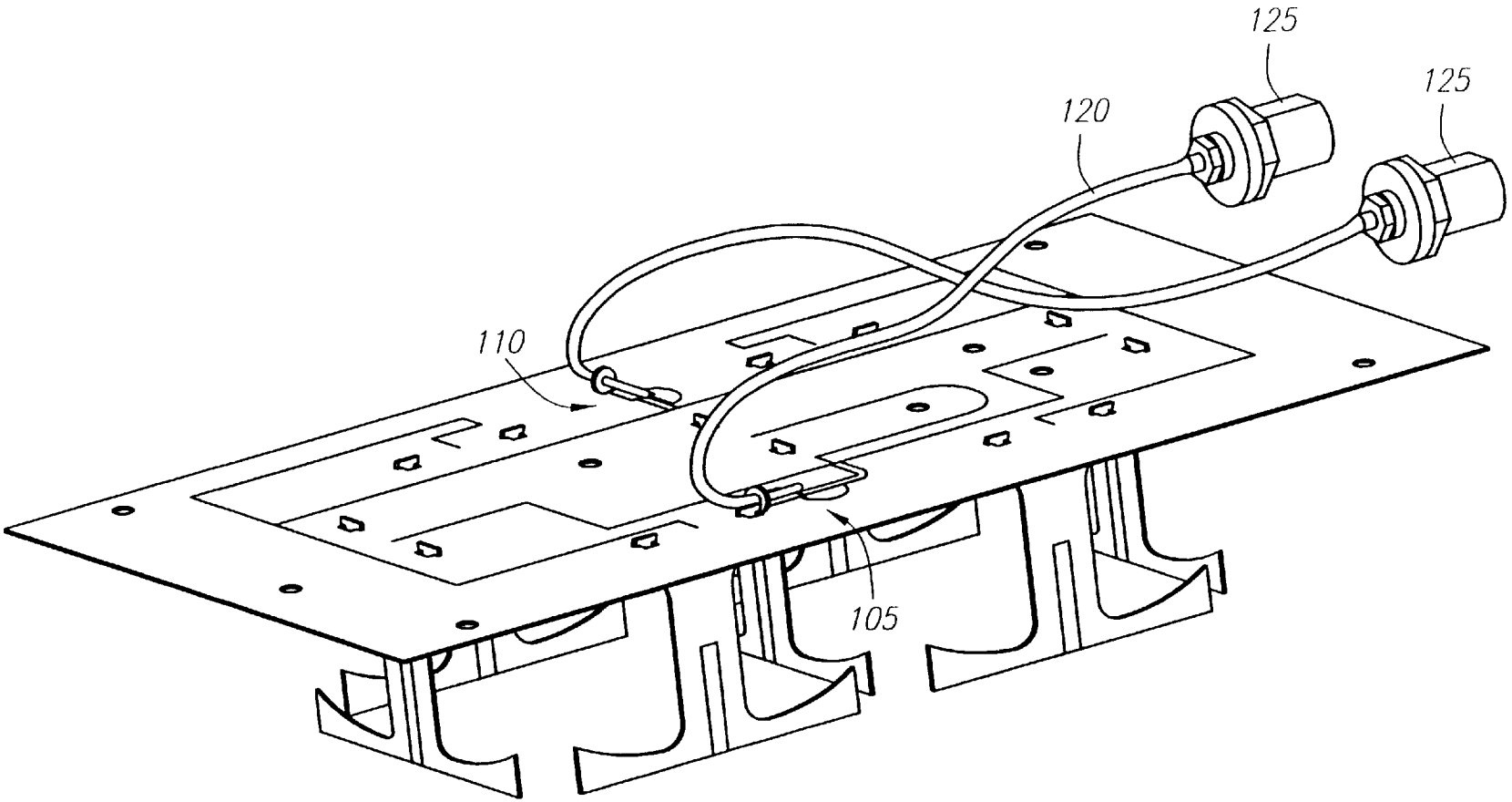
FIG. 8 is a perspective view of the bottom surface of the ground plane of FIG. 7.
Figure 9A:
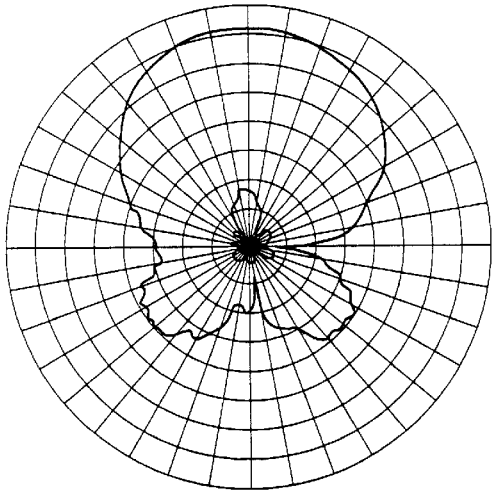
FIG. 9*a* is an illustration of the horizontally polarized E-plane cut radiation pattern of the array of FIG. 7.
Figure 9B:
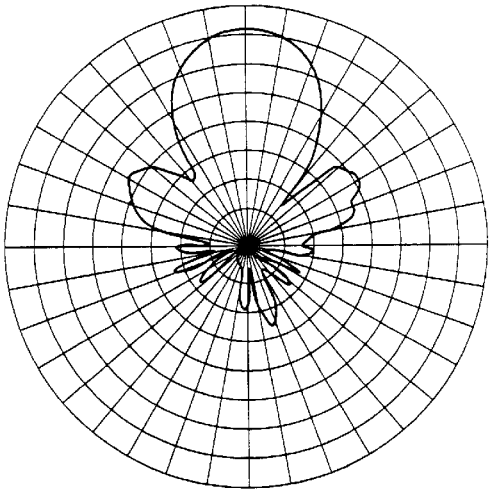
FIG. 9*b* is an illustration of the horizontally polarized H-plane cut radiation pattern of the array of FIG. 7.
Figure 9C:
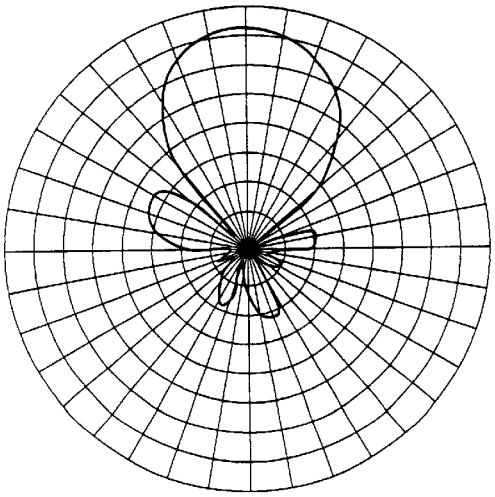
FIG. 9*c* is an illustration of the vertically polarized E-plane cut radiation pattern of the array of FIG. 7.
Figure 9D:
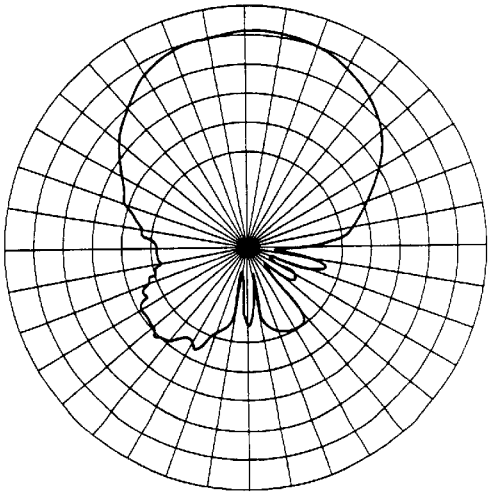
FIG. 9*d* is an illustration of the vertically polarized H-plane cut radiation pattern of the array of FIG. 7.

In another innovative aspect of the invention, the present invention is directed to a dual polarized compact antenna array having unequal elevation and azimuth beamwidths by adding extra T-shaped dipole antenna elements to the square array of FIGS. 3 and 4. Turning now to FIGS. 7–8, in one embodiment such an array comprises two vertically polarized T-shaped dipole antenna element pairs and three horizontally polarized T-shaped antenna elements. A first and a second T-shaped dipole antenna elements 5 are mounted on axis 90 on ground plane 51. A third and a fourth T-shaped dipole antenna elements 5 are mounted on axis 92 on ground plane 51 wherein axes 90 and 92 are mutually parallel. A fifth, sixth, and a seventh T-shaped dipole are mounted on axes 94, 96, and 98 on ground plane 51, respectively wherein axes 94, 96, and 98 are orthogonal to axes 92 and 90. The fifth, sixth, and seventh T-shaped dipoles antenna elements are positioned between axes 90 and 92 and the sixth antenna element is positioned between the first and second T-shaped dipoles. Because the first, second, third, fourth and sixth T-shaped dipole antenna elements are positioned between the fifth and seventh dipoles, the resulting antenna array is rectangular, comprising two of the square antenna arrays of FIGS. 3 and 4 wherein the two square arrays share the sixth dipole antenna element as can be seen from inspection of FIG. 7. Preferably, the axes 90 and 92 are spaced apart approximately a half wavelength of the center frequency. The first and second T-shaped dipoles on axis 90 are spaced apart approximately a half wavelength as are the third and fourth T-shaped dipoles on axis 92. Similarly, axes 94, 96, and 98 are spaced apart approximately a half wavelength of the center frequency. At the preferred center frequency of 1850 MHZ, this spacing equals 3.3 inches.

Other than having additional T-shaped dipole elements, the array of FIGS. 7 and 8 is very similar to the square array already described with respect to FIGS. 3 and 4. Thus, the ground plane 51 may comprise a printed circuit board substrate having opposing coplanar surfaces (i.e., a top surface illustrated in FIG. 7 and a bottom surface illustrated in FIG. 8) whereon respective layers of copper cladding are deposited. Features on the ground plane, such as microstrip feed lines 100 located on the bottom surface are preferably formed by etching away portions of the deposited copper cladding.

The set of horizontally polarized T-shaped dipole antenna elements are fed by a first equal phase power divider 105. Similarly, the set of vertically polarized T-shaped dipole antenna elements are fed by a second equal phase power divider 110. Each of the equal phase power dividers 105 and 110 comprises equal lengths of microstrip feed lines 100 attaching to the various T-shaped dipole antenna elements. The equal phase power dividers 105 and 110 are coupled through wires 120 to center conductors of coaxial connectors 125.

The outer conductors of the coaxial connectors 125 are coupled to the copper cladding coating the upper surface of the ground plane 51. In addition, as described with respect to the square antenna array of FIGS. 3 and 4, an array of small perforations (not shown) are distributed around the periphery of the ground plane 51 as well as on ground pads and holes act as ground vias. This insures that the respective copper cladding layers form a single, unified ground plane. To provide an impedance match between the microstrips 100 and the reactive feed strips 30, a quarter wave length transition section of microstrip line is implemented. The ground plane 51 with the mounted T-shaped dipole antenna array is secured within a housing similarly to the housing depicted in FIG. 5 for the corresponding square antenna array. It is to be noted that the present invention produces a dual polarized antenna array such that the labeling of antenna elements as vertically or horizontally polarized is arbitrary and depends upon the ultimate orientation of the housing with respect to the horizon. FIGS. 9*a* through 9*d* illustrate the elevation beamwidth (E-Plane) and azimuth beamwidths (H-Plane) for the horizontally polarized and vertically polarized components, respectively. Inspection of the figures reveals that the azimuth and elevation beamwidths for the vertical and horizontal polarized components are unequal. The vertically polarized component has an elevation and azimuth beamwidth of 30° whereas the horizontally polarized component has a 30° elevation beamwidth and a 65° azimuth beamwidth.

While those of ordinary skill in the art will appreciate that this invention is amenable to various modifications and alternative embodiments, specific examples thereof have been shown by way of example in the drawings and are herein described in detail. It is to be understood, however, that the invention is not to be limited to the particular forms or methods disclosed, but to the contrary, the invention is to broadly cover all modifications, equivalents, and alternatives encompassed by the spirit and scope of the appended claims.

What is claimed is:

1. A dual polarized antenna array comprising:

a ground plane;

a first and a second T-shaped dipole antenna element mounted along a first axis of the ground plane;

a third and a fourth T-shaped dipole antenna element mounted along a second axis of the ground plane wherein the first and second axes are mutually parallel, a fifth, a sixth, and a seventh T-shaped dipole antenna element mounted along a third, a fourth, and a fifth axis, respectively, of the ground plane, wherein the third, fourth and fifth axes are mutually parallel with one another and orthogonal to the first and second axes, the sixth T-shaped dipole antenna element being positioned between the first and second T-shaped dipole antenna elements, and the first and second T-shaped dipole antenna elements being positioned between the fifth and seventh T-shaped dipole antenna elements;

a first power divider coupled to the first, second, third, and fourth T-shaped dipole antenna elements; and a second power divider coupled to the fifth, sixth, and seventh T-shaped dipole antenna elements.

2. The antenna array of claim 1 wherein the ground plane comprises copper cladding deposited on a first side of a printed circuit board, and the first and second power dividers comprise copper cladding deposited on a second side of the printed circuit board to form microstrip line equal phase power dividers.

3. The antenna array of claim 1 wherein the first and second T-shaped dipole antenna elements are spaced apart 3.3 inches, the third and fourth T-shaped dipole antenna elements are spaced apart 3.3 inches, the first and third T-shaped dipole antenna elements being positioned broadside to one another, the second and fourth T-shaped dipole antenna elements being positioned broadside to one another, the first and second axes being spaced apart 3.3 inches, the fifth and sixth T-shaped dipole antenna elements being positioned broadside to one another and spaced apart 3.3 inches, and the sixth and seventh T-shaped dipole antenna elements being positioned broadside to one another and spaced apart 3.3 inches.

4. The antenna array of claim 3 further comprising a housing, the housing including:

a base providing a mounting for the ground plane and a mounting for a pair of coaxial connectors, one of the coaxial connectors being coupled to the first power divider, the other of the power dividers being coupled to the second power divider; and a cover adapted to be coupled to the base.

5. The antenna array of claim 1 wherein each of the T-shaped dipole antenna elements comprise:

a stem having a base and a top;

a pair of laterally extending arms attached to the stem, each arm having a top edge and a bottom edge, wherein the bottom edge of each arm comprises a first arcuate segment having a radius R1 and a second arcuate segment having a radius R2 wherein R2 is greater than R1 and the first arcuate segment merges with a side edge of the stem; and a reactive feed strip extending along the stem.

6. The antenna array of claim 5 wherein the top edge of each arn is aligned with the top of each stem, each stem having a longitudinally extending slot, each reactive feed strip extending along the stem by having a first, a second, and a third portion, the first portion extending from the base to an end of the first portion adjacent a first side of the slot, the third portion extending from an end of the third portion adjacent a second side of the slot towards the base, the second portion coupled between the ends of the first and third portions.

7. The antenna array of claim 6 wherein each first arcuate segment forms a quarter circle of radius R1.

8. The antenna array of claim 7 wherein R1 is 0.2 inches and R2 is 1.82 inches.

9. The antenna array of claim 8 wherein each slot has a width of 0.15 inches and extends longitudinally from the top of each stem a length of 0.95 inches.

10. The antenna array of claim 9 wherein the stem has a length of 1.97 inches.

* * * * *